United States Patent [19]

McAteer

[11] Patent Number: 4,729,224

[45] Date of Patent: Mar. 8, 1988

[54] INSTALLATION, APPARATUS AND METHOD FOR ACTUATING DOORS, GATES AND THE LIKE UNDER EXTREME ENVIRONMENTAL CONDITIONS

[76] Inventor: James D. McAteer, 8406 El Prado Ave., Orlando, Fla. 32817

[21] Appl. No.: 884,218

[22] Filed: Jul. 10, 1986

Related U.S. Application Data

[63] Continuation-in-part of Ser. No. 616,569, Jun. 4, 1984, abandoned.

[51] Int. Cl.[4] ..... F15B 15/18; F15B 21/04

[52] U.S. Cl. ..... 60/593; 91/4 R; 91/35; 91/397; 91/454; 92/134

[58] Field of Search ..... 91/35, 454, 4 R, 397, 91/398, 400; 92/134; 60/416, 593

[56] References Cited

U.S. PATENT DOCUMENTS

| | | | |
|---|---|---|---|
| 1,033,181 | 7/1912 | Larsson | 91/397 |
| 2,088,134 | 7/1937 | Haessler | 92/134 X |
| 2,099,368 | 11/1937 | Levy | 92/134 X |
| 2,472,694 | 6/1949 | Chouings | 91/454 X |
| 2,631,480 | 3/1953 | Romine et al. | 91/398 X |
| 2,933,069 | 4/1960 | Gratzmuller | 91/454 X |
| 3,124,371 | 3/1964 | Weir | 91/4 R |
| 3,564,842 | 2/1971 | Van Marle | 60/593 X |
| 3,570,244 | 3/1971 | Strobel et al. | 92/134 X |
| 3,802,318 | 4/1974 | Sibbald | 91/4 R |
| 3,891,126 | 6/1975 | Segawa | 92/134 X |
| 4,351,153 | 9/1982 | Kosmala | 60/593 X |
| 4,382,364 | 5/1983 | Thomas et al. | 60/593 X |
| 4,509,330 | 4/1985 | Zimber et al. | 60/593 X |
| 4,523,886 | 6/1985 | Reeves | 91/527 X |

FOREIGN PATENT DOCUMENTS

| | | | |
|---|---|---|---|
| 1453283 | 7/1969 | Fed. Rep. of Germany | 60/593 |
| 2412318 | 9/1974 | Fed. Rep. of Germany | 91/454 |
| 2047433 | 11/1980 | United Kingdom | 91/4 R |

*Primary Examiner*—Robert E. Garrett
*Assistant Examiner*—Mark A. Williamson

[57] ABSTRACT

An actuation installation for use under extreme environmental conditions, such as freezing, uses a two-fluid system in which one fluid is impervious to the extreme environment, and the other fluid, such as water, is not. A two-chamber accumulator-separator has a water chamber connected to a water source via control valves and a working fluid chamber connected to a hydraulic actuator port. The other actuator port is connected to a working fluid chamber of a two-chamber accumulator having a sealed air-pressure chamber. When water is admitted to the water chamber, the actuator will move in a first direction further compressing the air in the air pressure chamber. When the water is drained from the water chamber, the accumulator air-pressure moves the actuator in the opposite direction. The actuator is positioned in the extreme environment, with the remainder of the system installed in a protected environment such as underground.

15 Claims, 8 Drawing Figures

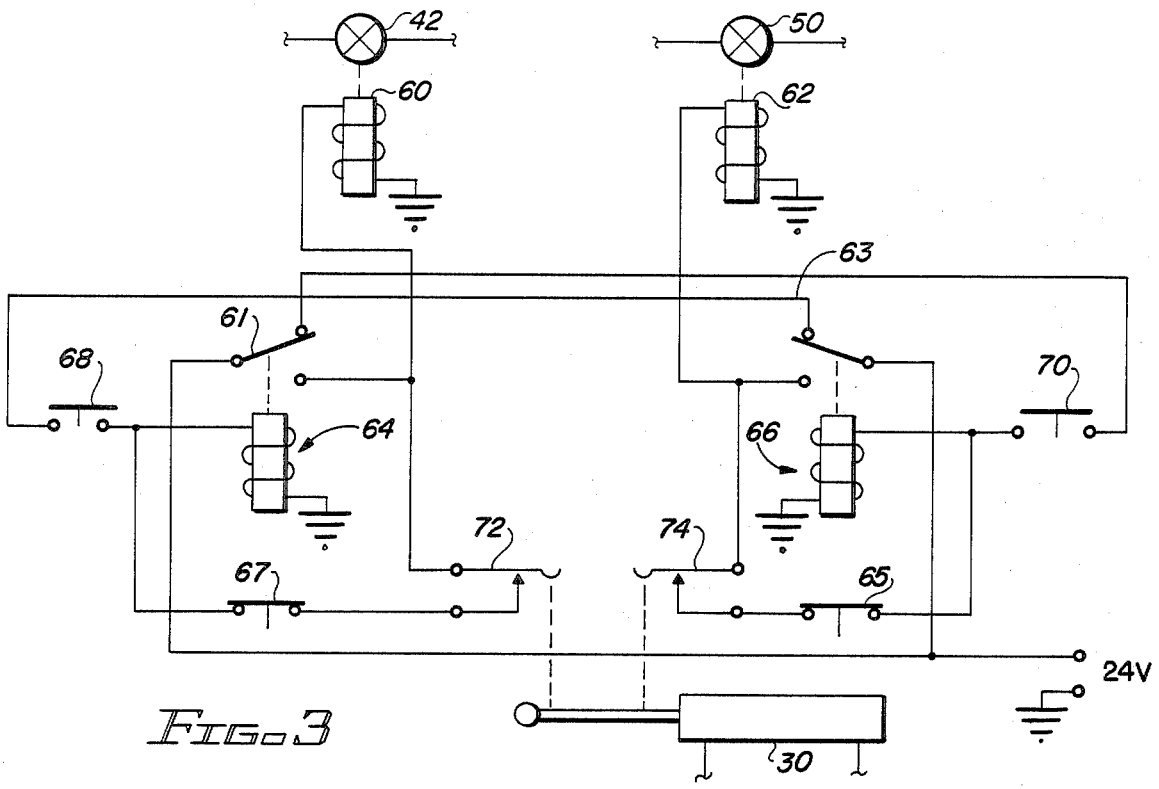
FIG. 3
FIG. 4
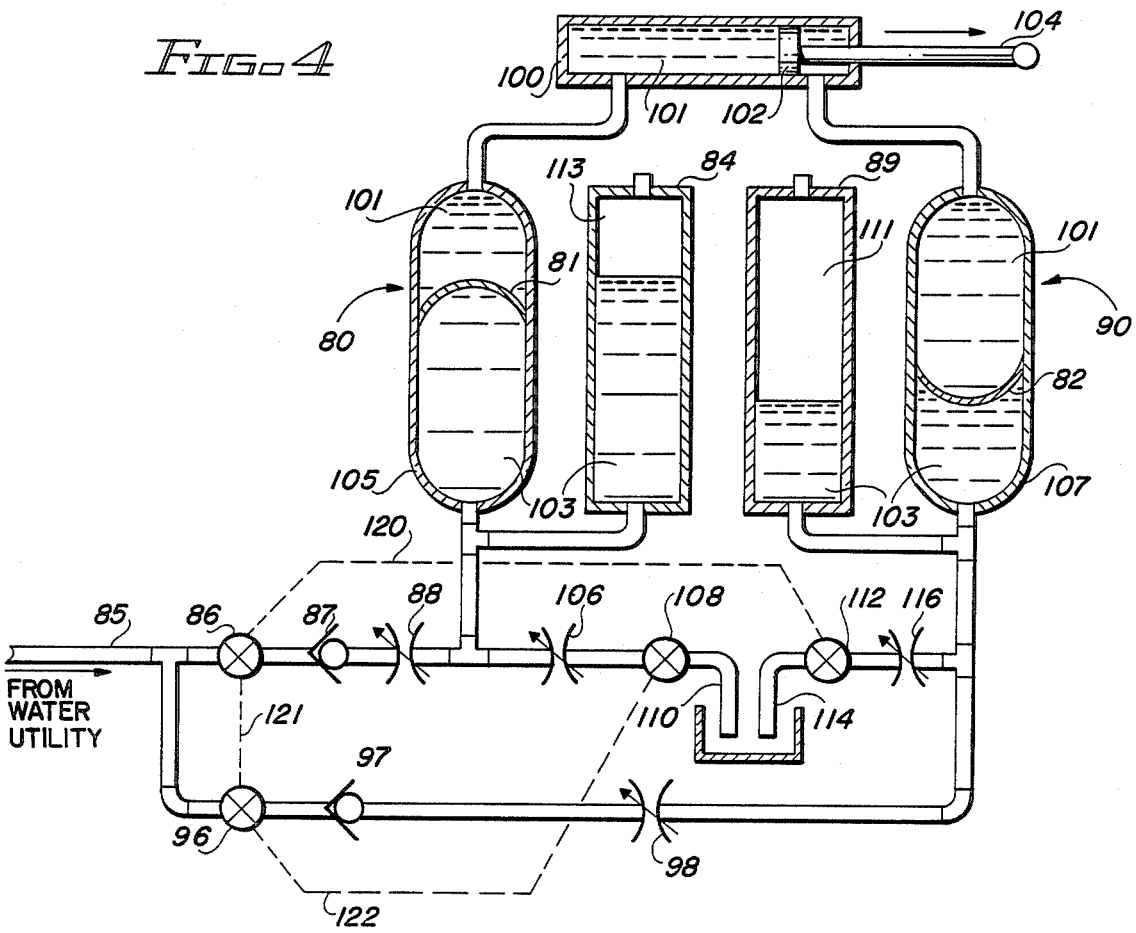

C
A
128
126
124
WF2
WF1
EXPOSED AREA
PROTECTED INSTALLATION
120
113
111
122
103
103
81
82
101
101
80
90
SUPPLY
CV
FLOW CONTROL VALVE
SOLENOID VALVE
SOLENOID VALVE
DISCHARGE
FLOW CONTROL VALVE
SOLENOID VALVE
SOLENOID VALVE
XFMR
115 VAC
24 VAC
LATCHING RELAY
RECEIVER (OPT)
CONTROL SWITCH
TIME DELAY RELAY
1
2
3
7
8
6
CONTROL BOX

INSTALLATION, APPARATUS AND METHOD FOR ACTUATING DOORS, GATES AND THE LIKE UNDER EXTREME ENVIRONMENTAL CONDITIONS

This application is a continuation-in-part of patent application Ser. No. 616,569 filed on June 4, 1984, now abandoned.

BACKGROUND OF THE INVENTION

1. FIELD OF THE INVENTION

The present invention relates to installations, systems and methods for actuating apparatus under extreme environmental conditions.

2. DESCRIPTION OF THE PRIOR ART

Many homes, farms, small businesses and the like have requirements for remote control of various devices and operations, such as doors and gates. For example, driveway gates and garage doors are often controlled from a vehicle. Conventionally, electric motors are used for powering gate and door openers requiring chain and sprocket drives, lead screw drives and similar devices. Hydraulic systems using linear actuators are better suited for gate openers since much simpler mechanical arrangements are required. In the prior art, the simplicity of the actuator is offset by the requirement for a pump, reservoir, drive motor and system accessories.

Where a water system is available, it is feasible to use the pressure from the system to power actuators for various applications. However, in order to actuate the remote door or gate, a portion of a water-actuated system must extend above ground. Under freezing conditions, a water-actuated system would be rendered useless.

Examples of prior art fluid actuation systems are described in the following U.S. Pat. Nos. 1,033,181 to Larsson; 2,009,368 to Levy; 2,631,480 to Romine, et al.; 3,124,371 to Weir; 3,564,842 to Van Marle; 3,570,244 to Strobel, et al.; 3,802,318 to Sibbald; 4,523,886 to Reeves; 4,351,153 to Kosmola; and 4,382,364 to Thomas, et al. See also, German Pat. No. 145-3283 and United Kingdom Pat. No. 2,047,433.

SUMMARY OF THE INVENTION

The present invention provides an installation, system and method for utilizing the pressure from a conventional water source, such as a public utility system, to power hydraulic actuators for performing various tasks under extreme environmental conditions. For example, water sources having pressures on the order of 40 psi are ideally suited.

In a preferred embodiment, the present invention comprises a two-fluid system having an accumulator and an accumulator-separator, each preferably of the type having a rigid vessel and a flexible diaphragm dividing the vessel into two chambers. The accumulator-separator has a connection between one chamber and the utility water line as will be described more fully below. The accumulator has one sealed chamber which may include a Schrader type valve to permit pressurizing with compressed air. Although a diaphragm type accumulator-separator is preferred, other types such as a free-moving piston type are suitable. Similarly, an accumulator without a diaphragm to separate the air chamber and the fluid chamber is satisfactory. The accumulator and accumulator-separator are installed in a protected environment, such as underground, near the gate, door, or other apparatus which is to be actuated.

One chamber of the accumulator and accumulator-separator is filled with a working fluid, such as oil, antifreeze or the like which is impervious to any extreme environmental conditions to which the installation may be subjected. A hydraulic actuator is installed in the extreme environment, and has one port connected to the working fluid chamber of the accumulator-separator and its other port connected to the working fluid chamber of the accumulator with the lines and actuator completely filled with the working fluid.

In one implementation of the water powered system the utility water line connects to a gate valve for turning water pressure off and on, followed by a check valve to prevent back flow of water. The check valve is connected to the first accumulator via a flow control valve which may be adjusted to control the rate of operation of the system in one direction. A drain line having a flow control valve and a gate valve is also connected to the first accumulator.

The volume of operating fluid in the actuator and accumulator chambers is adjusted so that the accumulator-separator is essentially full and the accumulator is essentially empty when the actuator is fully retracted with the water supply gate valve closed and the water drain valve open. To extend the actuator, the drain valve is closed and the water supply gate valve is opened. The pressure from the utility line causes the water chamber of the accumulator-separator separator to fill, with the diaphragm forcing the working fluid out of its chamber into the actuator. As the actuator extends, working fluid is forced into the accumulator, causing its diaphragm to compress the air in the air chamber.

To retract the actuator, the water supply valve is closed and the drain valve opened. The air pressure in the accumulator then forces the working fluid out and into the actuator. As the actuator retracts, working fluid is forced back into the accumulator-separator, causing that diaphragm to force the water in the water chamber out through the drain line. The flow control valves may be adjusted for a desired rate of operation of the actuator.

It is therefore a principle object of the present invention to provide an installation, system and method for producing useful work utilizing water and water pressure from a utility, and in which a second working fluid is used in an extreme environment.

It is another object of the invention to provide a water power installation, system and method having an accumulator and an accumulator-separator in which a water chamber in the accumulator-separator may be connected to a source of water under pressure or to a drain line and installed in a protected environment, but coupled hydraulically with a working fluid which can perform work in extreme environments.

It is yet another object of the invention to provide a water powered installation, system and method in which the extension and retraction of the actuator installed in an extreme environment may be controlled with valves.

It is still another object of the invention to provide a water powered actuator installation, system and method which is suitable for opening gates, doors and the like under extreme environmental conditions.

These and other objects and advantages of this invention will become apparent from the following detailed description when read in conjunction with the drawings.

BRIEF DESCRIPTION OF THE DRAWINGS

FIG. 3 is a schematic diagram of an electrical control system suitable for use with the water powered system shown in FIG. 1.

FIG. 4 is a schematic diagram of an alternative implementation of the invention using two accumulator-separators.

DETAILED DESCRIPTION

Figure 1:
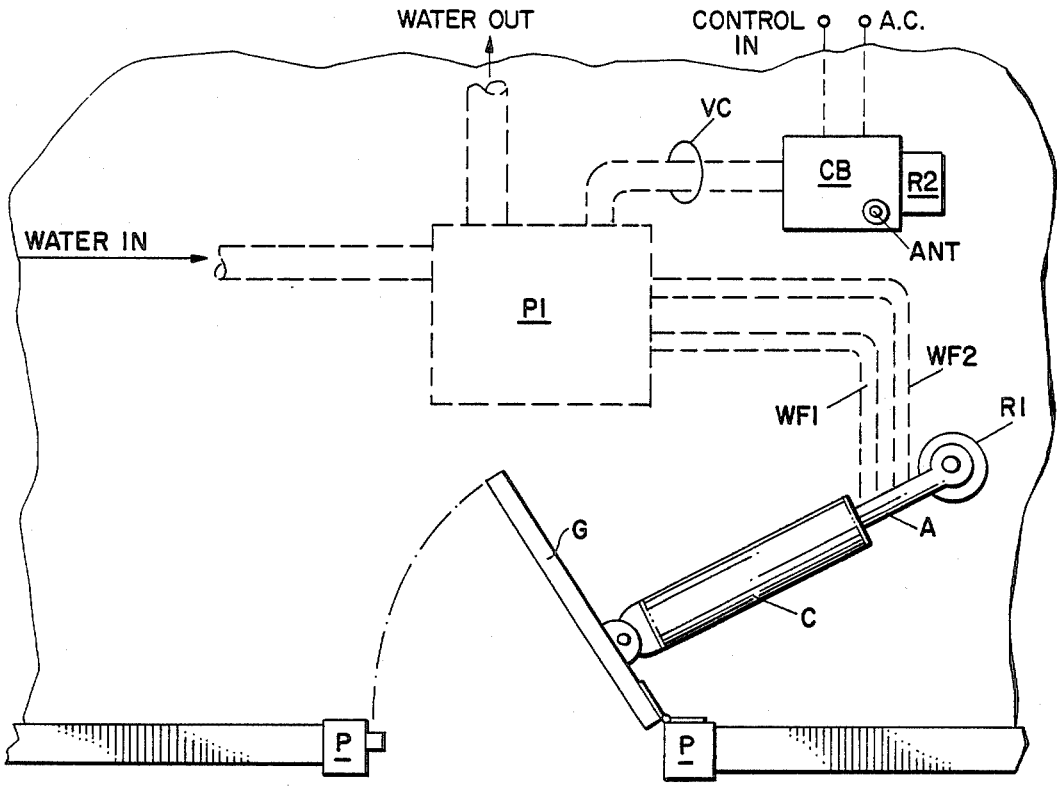
FIG. 1 is a top plan view of a typical remote gate-opening installation in accordance with the present invention.

I. Overall Description of the Installation for Use in Extreme Environmental Conditions FIG. 1 discloses a system in accordance with the present invention, as installed such that a portion of the system may be utilized in extreme environmental conditions, with the remainder of the system located in a protected environment. FIG. 1 depicts an installation or a gate G mounted between two posts P, and hinged to one of those posts. Attached to the gate G is a cylinder C and piston rod A combination, such that extension of the rod A into and out of the cylinder C causes the gate G to swing about its hinge for purposes of opening and closing.

The cylinder C and rod A are elevated via a riser R1 extending above the ground. A second riser R2 is also provided, and supports a control box CB which is described in greater detail below.

A protected installation PI, in the form of a container of sufficient size to house the various valves and equipment which is described in greater detail below with reference to FIGS. 2 through 8 is located in a protected environment, such as underground. The protected installation includes "water in" and "water out" connections, the "water in" connection preferably from a conventional source of water (such as a city water supply) and the "water out" connection typically being a drain field or similar output.

The protected installation PI further includes two working fluid connections, designated in FIG. 1 as "WF 1" and "WF 2." The "WF 1" and "WF 2" connections refer to working fluid inputs and outputs to and from the cylinder C and rod A combination. It will be understood that the "WF 1" and "WF 2" connections extend from the protected installation PI, and into the extreme environment where the cylinder C and rod A are located, for purposes of providing a pressurized working fluid to extend the rod A into and out of the cylinder C, for purposes of opening and closing the gate G. As noted above, the working fluid preferably comprises antifreeze, hydraulic oil or the like which is impervious to the extremities of the environment where the combination of the cylinder C and rod A are located.

The protected installation PI is also electrically coupled to the control box CB via a valve control loop VC. The control box CB includes a "control in" and "A.C." (for alternating current), to initiate the opening and closing of the gate G. Although not necessary, the control box CB may also include an antenna ANT for permitting operation of the system via a radio signaling device.

II. Operation of the Water and Working Fluid Systems

Figure 2:
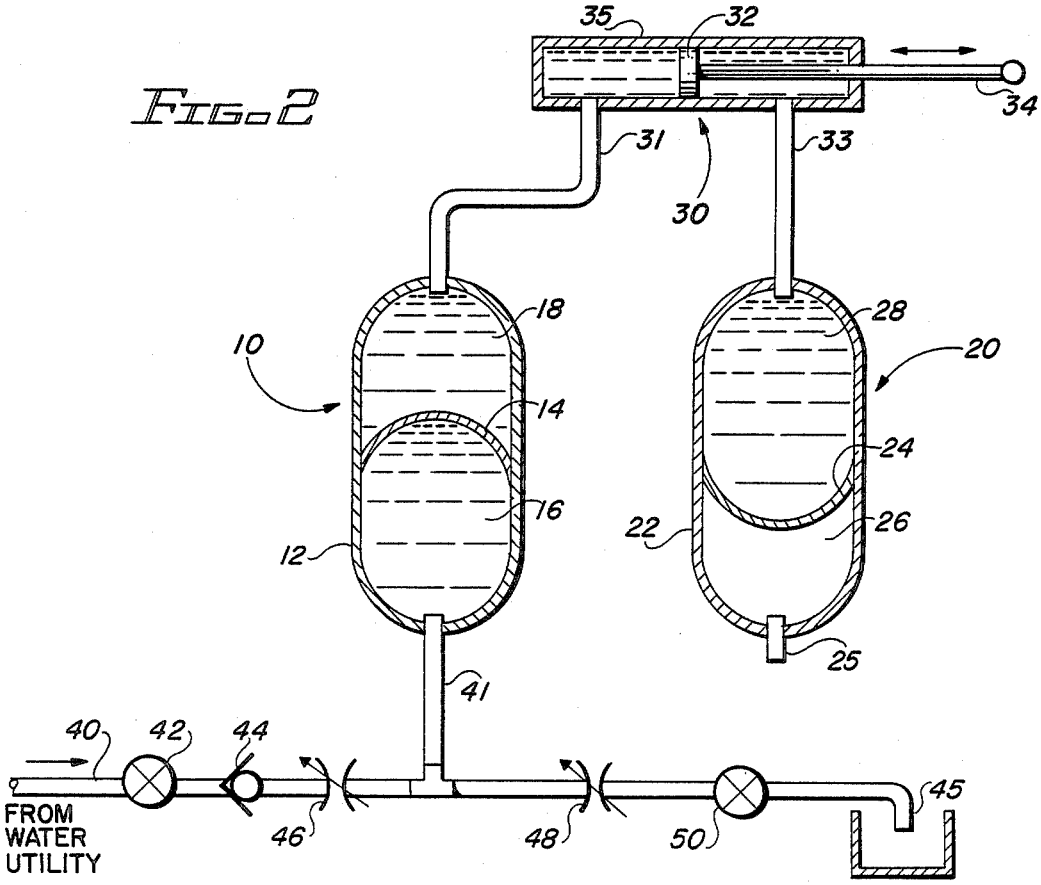
FIG. 2 is a schematic diagram of the water powered system of my invention in which the operation thereof is controlled manually by use of valves.

Referring now to FIG. 2, a schematic diagram of the basic system of my invention is shown. An accumulator-separator 10 is provided having a rigid vessel or shell 12 which may be formed from any suitable material such as steel or reinforced fiberglass. Vessel 12 is divided into two chambers by a flexible diaphragm 14. Chamber 16 is adapted to hold water under pressure while chamber 18 is to be filled with a working fluid which may be oil, a water-antifreeze mixture, or any suitable non-compressible liquid. Accumulator 20 has the identical construction of accumulator-separator 10 having vessel 22, diaphragm 24 and chambers 26 and 28. As will be noted, chamber 28 also holds the working fluid. However, chamber 26 is sealed and is filled with air. A valve 25 is provided in vessel 22 communicating with chamber 26. Valve 25 may be of the Schrader type or the like to permit introduction of air under pressure into chamber 26.

Actuator 30 has a first port 31 connected to working fluid chamber 18 and a second port 33 connected to working fluid chamber 28. Actuator 30 includes cylinder 35, piston 32 and actuator rod 34. It will be understood that the actuator 30 corresponds to the rod A of FIG. 1, and is intended to function in extreme environmental conditions.

Water chamber 16 in accumulator-separator 10 includes an inlet line 41 connected to a water utility line 40 via a gate valve 42, a check valve 44 and a flow control valve 46. Line 41 is also connected to a drain line 45 via gate valve 50 and flow control valve 48.

Having now described the basic elements of my system, the operation will now be explained. It will be assumed that gate valve 42 is turned to an OFF position with drain valve 50 also closed. As will be noted, piston 32 is shown approximately midway through its stroke. Air in air chamber 26 will be under pressure which will tend to force diaphragm 24 upward with such force being transferred to diaphragm 14 by the working fluid in the system and in chamber 18. To cause actuator 30 to retract, drain valve 50 is opened. The pressure on diaphragm 14 therefore forces the water in chamber 16 to flow out through line 41, flow control valve 48, and gate valve 50 and to be dumped via drain 45. The air pressure in chamber 26 is sufficient to force piston 32 to its fully retracted position with the result that accumulator-separator 10 may be essentially drained of water.

If it is then desired to extend actuator 30, drain valve 50 is closed and supply valve 42 is opened. Water under pressure from line 40 then enters accumulator-separator 10 via supply valve 42, check valve 44, flow control valve 46 and line 41. The pressure from the water in chamber 16 therefore pushes diaphragm 14 upward forcing the working fluid in chamber 18 into actuator 30 via first port 31 moving actuator rod 34 in its extended direction. This forces the working fluid from actuator 30 into chamber 28 forcing diaphragm 24 downward and further compressing the air in chamber 26. When actuator rod 34 is fully extended, the water flow will, of course, cease. The actuator may be locked in the fully extended position or any position between retracted and extended by closing supply valve 42 and maintaining both valves 42 and 50 closed. As will be understood, the cycle may be repeated by opening drain valve 50 to permit retraction. Flow control valve 46 is adjustable to control the rate of flow of water from the supply line 40 into chamber 16. Thus, the rate of extension of actuator rod 34 may be controlled by use of valve 46. Similarly, flow control valve 48 permits adjustment of the rate of retraction, of actuator rod 34.

Although I have shown in FIG. 2 for exemplary purposes a system in accordance with my invention in which the operation is controlled manually by opening and closing gate valves, the system may be controlled by means of electrical or pneumatic control valves. Thus, various automatic sequences can be developed and provided.

An example of an alternative control system for my invention is illustrated in schematic diagram form in FIG. 3.

Supply valve 42 and drain valve 50 in FIG. 2 are operated by solenoids 60 and 62 respectively. Relay 64 is connected to open supply valve 42 when operated and relay 66 operates drain valve 62. As will be noted, relay 64 is controlled by push button switch 68 through the normally closed contacts 63 of relay 66. Thus, if relay 66 is operated to open drain valve 50, valve 42 cannot be opened.

When relay 64 operates, solenoid 60 is energized, opening supply valve 42 which causes actuator 30 to extend. Closing of contacts 61 also holds relay 64 closed through limit switch 72. Limit switch 72 is disposed as indicated by the dashed line to open when actuator 30 is fully extended, releasing relay 64, closing supply valve 42. Push button switch 70 will operate relay 66 only when relay 64 is non-operated by virtue of the normally closed contacts 61 of relay 64.

When relay 66 closes, solenoid valve 62 opens drain valve 50, causing actuator 30 to retract. Contacts 63 hold relay 66 closed via limit switch 74. When actuator 30 is fully retracted, limit switch 74 opens as indicated by the dashed line, causing valve 50 to close. If it is desired to interrupt the operation of actuator 30 before it has completed its full stroke, normally closed push button switch 67 can be operated during extension of rod 34 and closed push button switch 65 can be operated during retraction of rod 34.

Although the control system can be operated from any convenient power supply, I prefer to use a low voltage AC supply such as 24 volts. Wiring may be installed with minimum requirements for insulation and electrical code restrictions.

Although I have shown a particular control system in FIG. 3, it will be obvious to those of skill in the art that many other control arrangements may be utilized. For example, latching relays in conjunction with time delay devices rather than interlocked relays may be used. While I have shown push buttons 68 and 70 to perform the operations described with regard to FIG. 2, it will be understood that remote control relays associated with a radio or ultrasonic receiver may be substituted therefor such that operation of the system may be effected from an automobile by means of a radio or ultrasonic transmitter. Similarly, photocells or other radiation-sensitive detectors to close such contacts may be used as is well known in the art.

An alternative embodiment of my invention is shown in the schematic diagram of FIG. 4 having two accumulator-separators 80 and 90 identical to the accumulator-separator 10 described with respect to FIG. 2. Accumulator-separators 80 and 90 each have a first chamber 105, 107 communicating with the water utility line 85. An actuator 100 is connected to the second chamber of each accumulator-separator with the second chambers and actuator filled with a secondary fluid 101 such as oil or antifreeze solution. In addition, the system of FIG. 4 includes expansion chambers 84 and 89 connected respectively to accumulator-separators 80 and 90. Each expansion chamber includes an air space 113 and 111 respectively. Water 103 under pressure from the water utility line 85 is admitted to the lower chamber of accumulator-separator 80 and to expansion chamber 84 by means of gate valve 86, check valve 87 and flow control valve 88 in the manner previously described with respect to FIG. 1. Accumulator-separator 90 and expansion chamber 89 are similarly controlled by gate valve 96, check valve 97 and flow control valve 98. Water 103 is drained from accumulator-separator 80 via flow control valve 106 and gate control valve 108, while flow control valve 116 and gate valve 112 drain water 103 from accumulator-separator 90.

As shown in FIG. 4, piston 102 is moving to the right to extend actuator rod 104. In this mode of operation, gate valve 86 is open and drain valve 112 is open. Thus, the pressure on diaphragm 81 is forcing secondary fluid 101 to move piston 102 to the right as indicated by the arrow. This causes secondary fluid 101 in accumulator-separator 90 to force diaphragm 82 downward causing water 103 to drain via drain line 114. As shown by dotted line 120, valve 86 and valve 112 are interconnected such that when valve 86 is open, then valve 112 will be open. As will be noted, similar relationship exists between supply valve 96 for accumulator-separator 90 and drain valve 108 for accumulator-separator 80 as indicated by dashed line 122. Additionally, as shown by dashed line 121, supply valve 86 for accumulator-separator 80 is interlocked with supply valve 96 for accumulator-separator 90 such that valve 96 and 108 will be closed when valves 86 and 112 are open and vice versa.

After actuator 100 is fully extended, the control system will close valves 86 and 112 preparatory for retraction of actuator 100. When it is desired to retract actuator 100, valves 96 and 108 are opened causing water from utility line 85 to flow into accumulator-separator 90 and water to drain from accumulator-separator 80 via drain line 110.

Expansion chambers 84 and 89 serve to equalize pressures between accumulator-separators 80 and 90 which might occur due to changes in ambient temperature and which could otherwise affect the rate of operation of actuator 100.

As will be understood, the control system of FIG. 2 is suitable for operating this implementation of my invention wherein valves 86, 112, 96 and 108 are solenoid-operated valves in which the interconnections indicated by dashed lines 120, 121 and 122 may be accomplished electrically through the control relay contacts.

Figure 5:
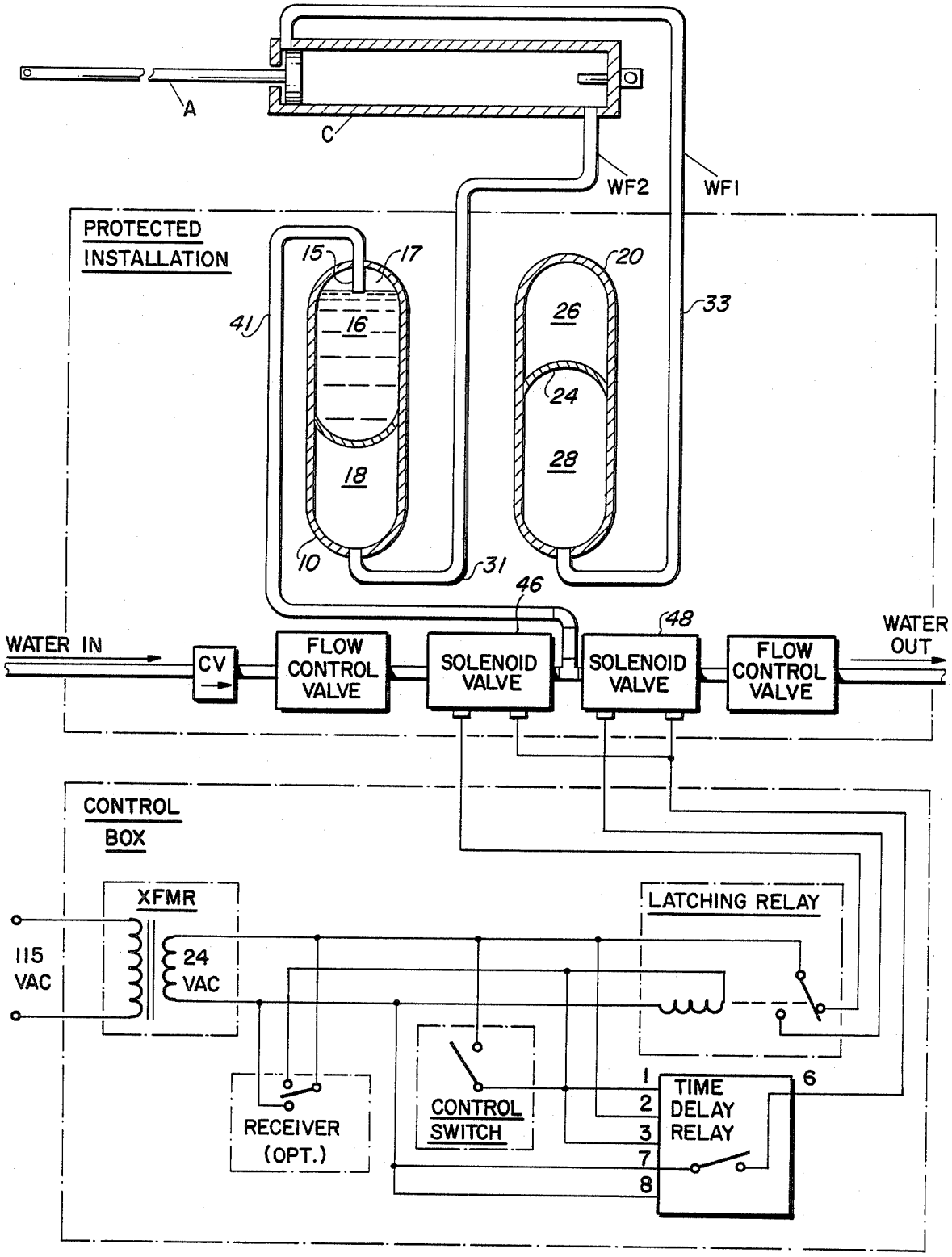
FIGS. 5–8 further depict the details of the installation of FIG. 1 utilizing the water-actuation system of the present invention.
Figure 6:
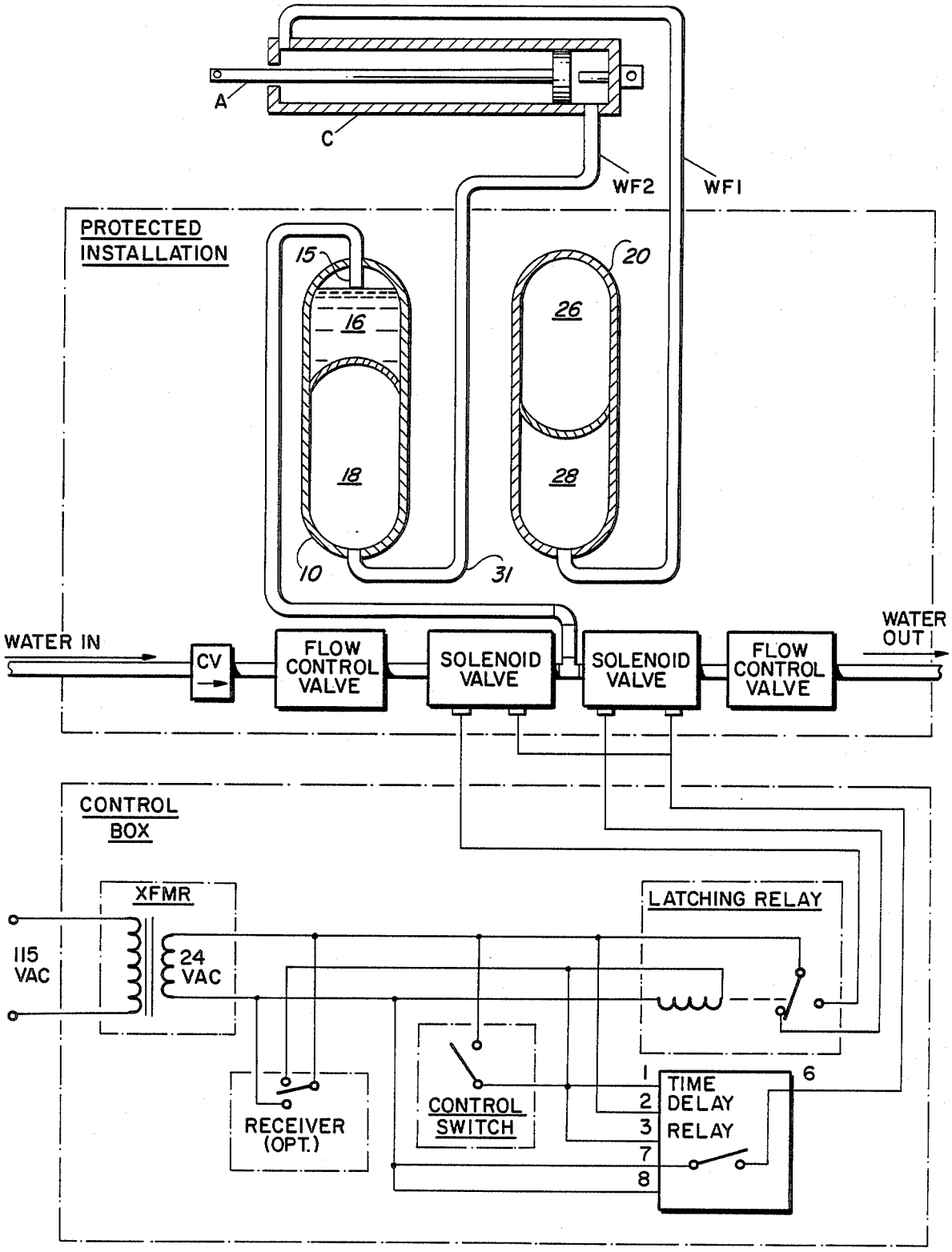

III. Detailed Description of the Water-Working Fluid System Under Extreme Environmental Conditions FIGS. 5 and 6 depict an installation of FIG. 1, utilizing the system of FIG. 2 (with some modifications as to the system of FIG. 2). In FIGS. 5 and 6, like reference numerals refer to the same elements of FIGS. 1 and 2.

Noting FIG. 5, the actuator A and cylinder C are located in an exposed extreme environment while the accumulator-separator 10 and the accumulator 20 are located within the protected installation (element PI in FIG. 1). Fluid lines 31 and 33, respectively, are connected to working fluid line WF2 and WF1. The system of FIG. 5 differs from that of FIG. 2, in that a stand-pipe 15 connected to input line 41 is provided, the stand-pipe extending slightly into the portion of the accumulator-separator forming the water chamber 16. A volume of air 17 is permitted to be trapped above the mouth of the stand-pipe 15. As is noted in FIG. 6, pressurization of the working fluid 18 in the accumulator-separator 10 will compress the air 17 above the mouth of the stand-pipe 15, under low pressure conditions.

In the system of FIGS. 5 and 6, the manner of operation of actuator A through the cylinder C is seen as the pressurization in the accumulator-separator 10 and the accumulator 20 varies.

Figure 7:
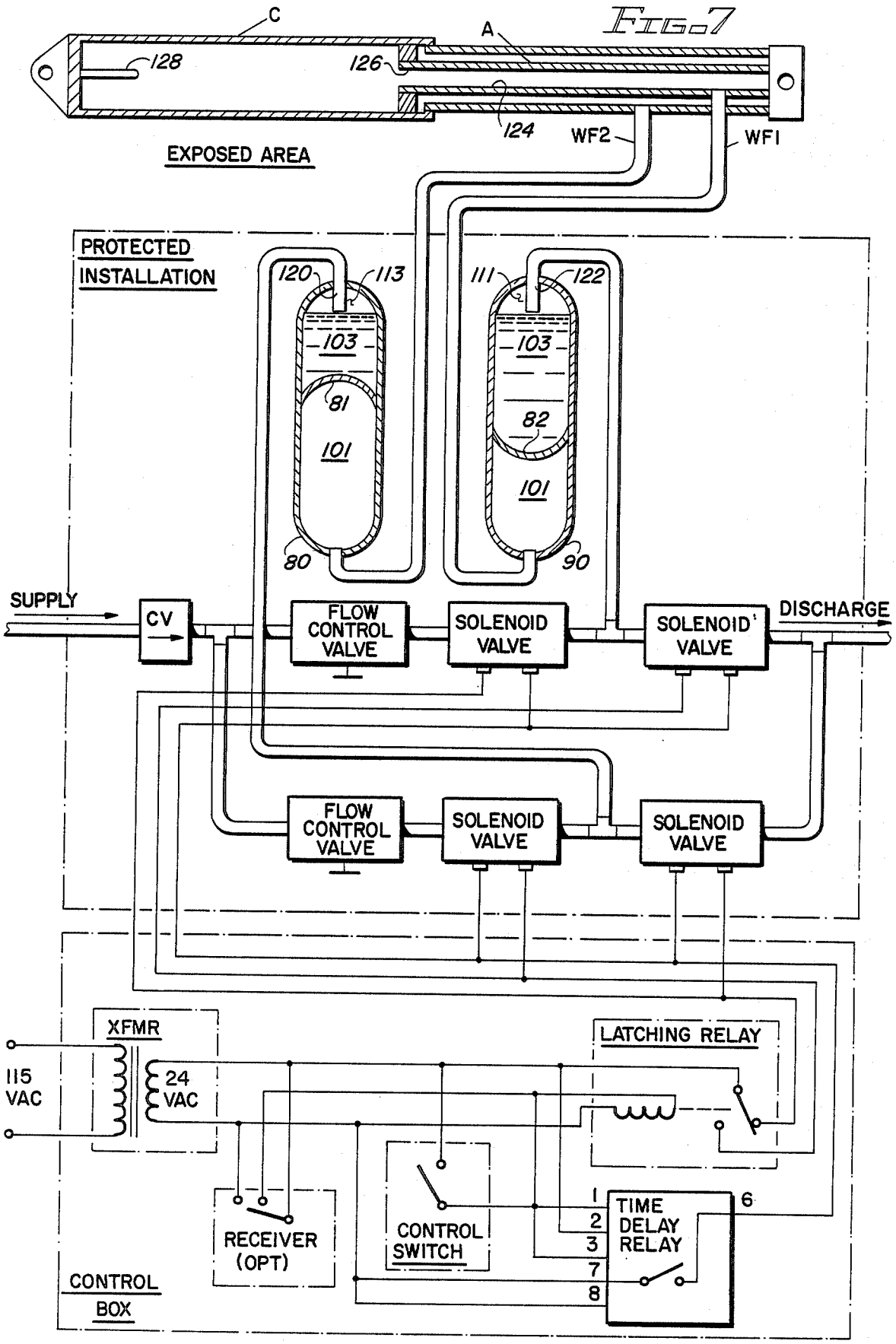
Figure 8:
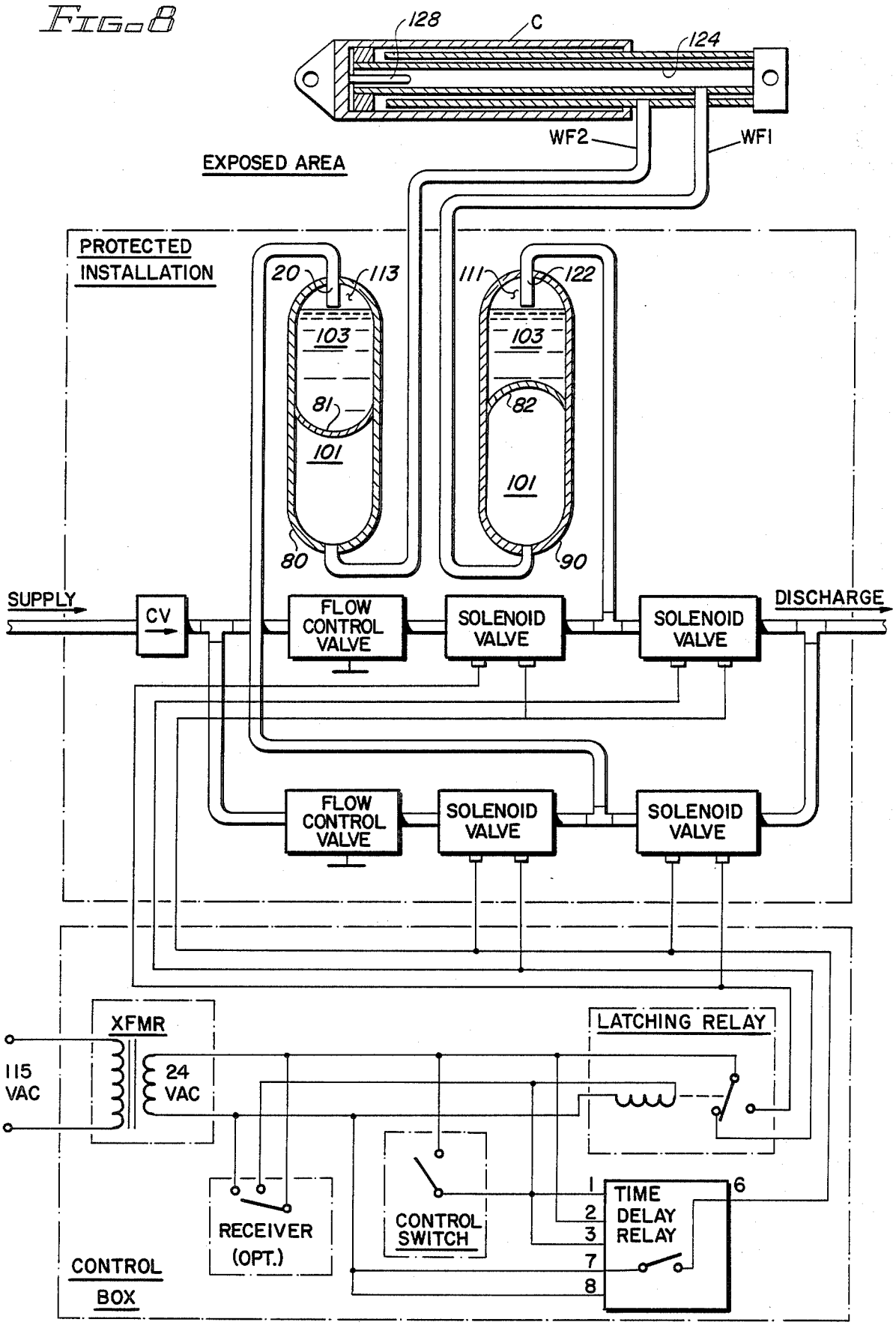

Reference is now made to FIGS. 7 and 8, which depicts a system similar to that of FIG. 4 (with some modifications) utilized in the installation of FIG. 1. As is shown, the cylinder C and accumulator A are located outside of the protected installation. In a manner similar to FIGS. 5 and 6, the system of FIGS. 7 and 8 differs from that of FIG. 3 in that a stand-pipe 120, 122 is provided in each of the accumulator-separators 80, 90 above the water chamber 103, with a small volume of air 113, 111 respectively, above the bottom of the respective stand-pipe 120, 122. (It will be understood that those volumes of air correspond to the air volumes 113 and 111 the expansion chambers 84 and 89 in FIG. 4).

The system of FIGS. 7 and 8 also varies from the system of FIG. 4 in that the working fluid is fed into the cylinder C and accumulator A combination through the center of the actuator, rather than through the side walls of the cylinder, as is depicted in FIGS. 2 and 4. This is accomplished with a cylindrical bore 124 through the center of the actuator A and coupled to the working fluid line WF1. The bore 124 exits into the cylinder C at an orifice 126. A pin 128 is provided at the opposite extremity of the cylinder C, and in axial alignment with the orifice 126. As the actuator A is forced toward the pin 128 upon pressurization from working fluid line WF2, the pin 128 extends into the orifice 126; the pin 128 is provided with a taper, so as to gradually restrict the cross-sectional area of the orifice 126, thereby gradually reducing the flow of working fluid through the bore 124. The pin 128 in the seated configuration is shown in FIG. 8.

Again, it will be understood that the cylinder C and accumulator A of FIGS. 7 and 8 are installed in an exposed, extreme environment while the remainder of the installation, as depicted in FIG. 1, are protected from the extreme environments.

It will thus be understood by those skilled in the art that the above-described invention provides for an installation utilizing a two-fluid system, in which a working fluid impervious to extreme environmental conditions (such as freezing) may be utilized to actuate equipment and apparatus in an extreme environment, but be initiated by a conventional water supply which would not function in the extreme environment because of freezing, or other limitations.

What is claimed is:

1. An installation for actuating gates, doors or the like in extreme environmental conditions from a conventional source of water under pressure, said installation comprising:

an installation which is protected from extreme environmental conditions, such as freezing temperatures or the like, including a rigid accumulator-separator vessel into a water chamber and a first working fluid chamber, a rigid accumulator vessel with means dividing said accumulator vessel into a second working fluid chamber and an air chamber;

a water supply line connected to said water source;

a supply value having an inlet port connected to said water supply line and an outlet connected to said water chamber;

a drain valve having an inlet port connected to said water chamber;

a hydraulic actuator positioned in an environment which is subject to extreme environmental conditions, such as freezing temperatures or the like, and having a first port connected to one of said working fluid chambers and a second port connected to the other of said working fluid chambers; and wherein said working fluid chambers and said actuator are filled with a working fluid which is impervious to extreme environmental conditions.

2. The installation recited in claim 1 wherein:

said movable means is a first flexible diaphragm; and said accumulator dividing means includes a second flexible diaphragm for dividing said accumulator vessel into said second working fluid chamber and said air chamber.

3. The installation recited in claim 2 further comprising a second flow control valve connected between said water chamber and an inlet of said drain valve.

4. The installation recited in claim 1 further comprising:

a check valve; and a first adjustable flow control valve, said check valve and said first flow control valve connected between said water chamber and said outlet of said supply valve.

5. The installation recited in claim 1 in which said air chamber includes means for adding compressed air thereinto.

6. The installation recited in claim 1 wherein:

said supply valve includes a solenoid for electrical control thereof; and said drain valve includes a solenoid for electrical control thereof.

7. The installation recited in claim 6 further comprising control means connected to said supply valve solenoid and said drain valve solenoid for sequentially causing said supply valve and said drain valve to open.

8. The installation recited in claim 7 in which said control means comprises:

first electrical relay means operatively connected to said supply valve solenoid;

second electrical relay means operatively connected to said drain valve solenoid;

first switch for operating said first relay means;

second switch for operating said second relay means;

said first and second relay means electrically interlocked wherein only one of said relay means can be closed at a time.

9. The installation recited in claim 8 in which said control means further comprises limit switch means disposed to be controlled by said actuator, said limit switch means connected to said first and second relay means to release said relay means at preselected positions of said actuator.

10. The installation recited in claim 1 wherein said accumulator-separator includes a stand-pipe therein and a compressible volume of air above the extremity of said stand-pipe.

11. An installation for actuating gates, doors or the like in extreme environmental conditions from a conventional source of water under pressure, said installation comprising:

an installation which is protected from extreme environmental conditions, such as freezing temperatures or the like, including a first rigid accumulator-separator vessel having a first flexible diaphragm, said diaphragm dividing said first vessel into a first water chamber and a first working fluid chamber, and a second rigid accumulator-separator vessel having a second flexible diaphragm, said diaphragm dividing said second vessel into a second working fluid chamber and a second water chamber;

a hydraulic actuator located in an environment which is subject to extreme environmental conditions, such as freezing temperatures or the like, and having first port connected to said first working fluid chambers and a second port connected to said second working fluid chambers, said first and second working fluid chambers and said actuator filled with a working fluid impervious to conditions in said extreme environment;

a water supply line connected to a source of water under pressure;

a first supply valve having an inlet port connected to said water supply line and an outlet connected to said first water chamber;

a first drain valve having an inlet port connected to said first water chamber;

a second supply valve having an inlet port connected to said water supply line and an outlet connected to said second water chamber;

a second drain valve having an inlet port connected to said second water chamber; and wherein said water pressure may be utilized to operate said actuator in said extreme environment.

12. The installation recited in claim 11 which further comprises:

a first expansion chamber connected to said first water chamber; and a second expansion chamber connected to said second water chamber.

13. The installation recited in claim 12 which further comprises:

a first check valve;

a first adjustable flow control valve, said first check valve and said first flow control valve connected between said first water chamber and said outlet of said first supply valve;

a second check valve; and a second adjustable flow control valve, said second check valve and said second flow control valve connected between said second water chamber and said outlet of said second supply valve.

14. A method for actuating a gate, door or the like in a location subject to extreme environmental conditions such as freezing temperatures or the like, from a conventional source of water under pressure, said method comprising of the steps of:

providing an installation protected from said extreme environmental conditions and having a source of water under pressure and a working fluid impervious to said extreme environmental conditions;

separating said water from said working fluid;

pressurizing said working fluid with said water under pressure;

positioning an actuator in said location subject to said extreme environmental conditions and coupling said actuator to said gate, door or the like; and actuating said actuator with said working fluid in said protected installation to thereby operate said gate, door or the like in said location.

15. The method recited in claim 14 further comprising the steps of:

providing an enclosed volume of a compressible gas in said protected installation;

separating said enclosed compressible gas from said working fluid;

pressurizing said enclosed volume of compressible gas with said working fluid during actuation of said actuator; and thereafter returning said actuator to an original position by pressure from said enclosed volume of compressible gas upon said working fluid.

* * * * *